United States Patent [19]

Osada

[11] 4,292,738

[45] Oct. 6, 1981

[54] KNIFE

[75] Inventor: Hiroshi Osada, Seki, Japan

[73] Assignee: Kai Cutlery Center Co., Ltd., Seki, Japan

[21] Appl. No.: 112,515

[22] Filed: Jan. 16, 1980

[30] Foreign Application Priority Data

Jan. 20, 1979 [JP] Japan ..... 54-4540[U]
May 21, 1979 [JP] Japan ..... 54-66905[U]

[51] Int. Cl.[3] ..... B26B 5/00
[52] U.S. Cl. ..... 30/162; 30/339
[58] Field of Search ..... 30/162, 335, 337, 339

[56] References Cited

U.S. PATENT DOCUMENTS

| | | | |
|---|---|---|---|
| 4,063,356 | 12/1977 | Hepworth | 30/162 |
| 4,170,062 | 10/1979 | Machida | 30/162 |
| 4,196,515 | 4/1980 | Sugiyama | 30/162 |
| 4,200,977 | 5/1980 | Kageyama | 30/162 |
| 4,209,900 | 7/1980 | Gilbert | 30/162 |

*Primary Examiner*—Jimmy C. Peters
*Attorney, Agent, or Firm*—Norbert P. Holler

[57] ABSTRACT

A knife having an elongated holder provided therein with a channel to the exterior at its upper side through a slot provided in the top wall of the holder, a blade carrier having a slider slidably received by the channel of the holder, and a blade detachably secured to the blade carrier through an engagement between a projection formed on the front end portion of the slider and an aperture formed in the base portion of the blade. The knife further has a spring or the like for resiliently biasing the front end portion of the slider to bring the projection into engagement with the cooperating aperture in the blade, and a manually depressable finger portion for causing a downward movement of the front end portion of the slider to disengage the projection from the aperture in the blade against the resilient biasing force. The finger portion, which is integral with the slider through the slot, has a width greater than that of the slot, so that the finger portion cannot be depressed normally. A transverse enlargement of the slot in the top wall of the holder is adapted to receive the front end portion of the finger portion to permit the depression of the latter, thereby to disengage the projection of the slider from the aperture of the blade, only when the blade carrier has been slid to a predetermined position in the channel.

6 Claims, 7 Drawing Figures

KNIFE

BACKGROUND OF THE INVENTION

The present invention relates to a knife of the type having an elongated holder with a C-cross-sectioned groove or channel slidably receiving a blade carrier detachably carrying a blade. More particularly, the invention is concerned with an improved structure for an easy attaching and detaching of the blade to and from the slidable blader carrier.

Knives have been known having an elongated holder having a C-cross-sectioned groove or channel opened at its upper side, a blade carrier slidably received by the channel and a blade detachably secured to the blade carrier. The slidable blade carrier has a resilient tab which engages successively a series of notches formed in one of the side edges defining the upper opening of the channel. Slits or lines of breakage are formed in the blades to permit an easy breaking of the exposed portion of the blade when the latter has become dull. After the breakage, the slidable blade carrier is moved ahead to project a new portion of the blade.

In the conventional knife of the kind described, after the last part of the blade has become dull, the blade is renewed by a procedure as explained below. Namely, for the renewal of the blade, a rear end closure of the holder is detached from the holder to open the rear end of the channel. Then, the blade carrier is fully retracted and drawn out of the holder together with the blade. The blade is then detached from the blade carrier and a new blade is attached to the same. The assembly of the blade carrier and the new blade is then inserted into the channel of the holder and slid fowardly. Finally, the end closure is attached to the holder to close the rear end of the channel.

Thus, a troublesome and time-consuming work is required in the conventional knife for the renewal of the blade.

SUMMARY OF THE INVENTION

It is, therefore, an object of the invention to provide an improved knife of the kind described which permits an easy renewal of the blade.

To this end, according to the invention, there is provided a knife having an elongated holder with a channel opened at its upper side, a blade carrier slidably received by the channel and a blade detachably secured to the blade carrier through an engagement of a projection formed on a slider of the blade carrier and an aperture formed in the base or rear portion of the blade, characterized by comprising resilient means for resiliently biasing the portion of the slider having the projection into engagement with the aperture formed in the base portion of the blade, manually depressable means for causing a downward movement of the portion of the slider carrying the projection to disengage the projection from the aperture by overcoming the resilient biasing force, and locking means adapted to lock the manually depressable means against the depression.

Preferably, means are provided for permitting the manually depressable means to be depressed only when the blade carrier takes a predetermined position in its sliding stroke.

The resilient means may include portions of reduced thickness of the slider of the blade carrier, which are formed around a substantially U-shaped slot formed in the front end portion of the slider of the blade carrier, the portion of the slider inside of the U-shaped slot carrying the projection for engaging the aperture in the blade. Alternatively, the resilient means may include a spring attached to the lower side of the front end portion of the slider.

The manually depressable means may be constituted by a finger retaining member which is preferably formed unitarily with the blade carrier. The locking means may be constituted by at least a portion of the finger retaining member positioned above the upper surface of the holder and having a width greater than the width of the upper opening of the channel. In this case, the means for permitting the depression of the manually depressable means may be constituted by an opening formed in the upper wall of the holder and sized and positioned such that the above-mentioned portion of the finger retaining member can be moved downwardly to cause the resilient deflection of the slider of the blade carrier only when the blade carrier takes the aforementioned predetermined position.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
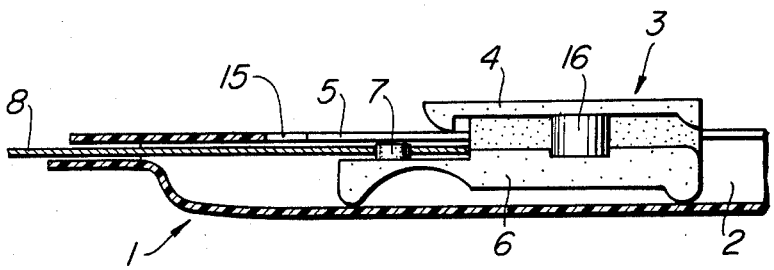
FIG. 1 is a longitudinal sectional view of a knife embodying the present invention.

Referring first to FIGS. 1 to 5 inclusive showing a first embodiment of the invention, a knife has an elongated holder 1 made of a plastic or the like material and provided with a C-cross-sectioned groove or channel 5 which opens in the upper face of the holder 1. One of the side edges 19 defining the upper opening of the channel 5 has a series of notches 17 adapted to be resiliently engaged by a resilient stopper 16 of a slidable blade carrier which will be mentioned later.

The channel 5 of the holder 1 slidably receives the above-mentioned blade carrier which is generally designated by a numeral 3. The blade carrier has a slider 6 which extends in the longitudinal direction of the holder 1 and is received by the channel 5. The blade carrier 3 has a vertical wall portion through which the slider 6 is unitarily connected to a finger-retaining portion 4 which is adapted to be normally positioned above the top surface of the holder 1, as will be clearly understood from FIG. 1.

The finger retaining portion 4 has a width which is greater than that of the upper opening of the channel 5 of the holder 1. The finger retaining portion 4 has a generally flat form and projections 13, 14 extending downwardly from the lower surface at the front and rear end portions thereof.

Figure 3:
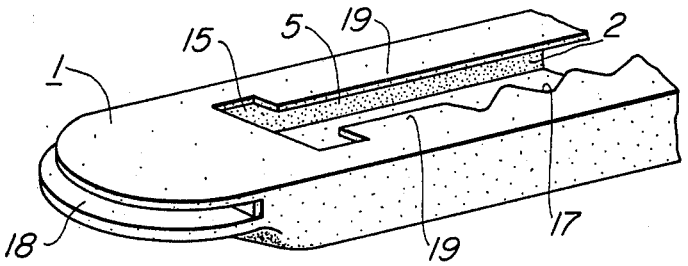
FIG. 3 is a perspective view of a front part of the holder of the knife shown in FIG. 1.
Figure 4:
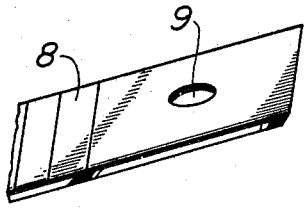
FIG. 4 is a perspective view of the rear part of the blade of the knife shown in FIG. 1.

As will be most clearly seen from FIG. 3, the holder 1 has an opening 15 formed in the upper wall thereof. The upper opening 15 is connected to the front end of the upper opening of the channel 5 and has a width which is large enough to receive the projection 13 of the finger retaining portion 4 when the blade carrier 3 and hence the finger retaining portion 4 has been moved forwardly to a predetermined position.

Figure 5:
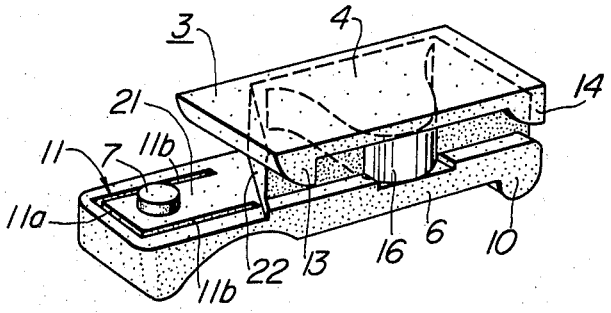
FIG. 5 is a perspective view of the blade carrier of the knife shown in FIG. 1.

Referring now to FIG. 5, the blade carrier 3 includes the aforementioned resilient stopper 16 mounted therein. The stopper 16 is of mountain-like configuration (see FIG. 5) having an apex adapted to resiliently engage with the selected one of the notches 17.

The slider 6 of the blade carrier is provided at its front and rear ends with legs 10, 10 for sliding contact with the bottom of the channel 2, as shown in FIG. 1.

A substantially U-shaped slot 11 is formed in the front end portion of the slider 6 such that the portion 11*a* interconnecting longitudinally extending side portions 11*b* of the slot is positioned in the vicinity of and in parallel with the front edge of the slider 6. As will be most clearly understood from FIG. 5, the side walls of the slider 6 have a reduced thickness at portions thereof extending along the side portions 11*b* of the slot 11 so that the front end portion of the slider 6 outside the U-shaped slot 11, can be resiliently deformed relatively to the portion 21 of the upper wall of the slider 6 defined by the U-shaped slot 11.

The portion 21 of the upper wall of the slider 6 defined by the U-shaped slot has a circular projection 7 formed unitarily therewith. The projection 7 is adapted to be received by an aperture 9 formed in the base or rear end portion of the blade 8 from the lower side of the latter in a manner shown in FIG. 1.

In the assembled state, the slider 6 of the blade carrier 3 is received by the channel 2 of the holder 1, while the finger retaining portion 4 is positioned such that the front and rear downward projections 13, 14 can slide along the upper surface of the holder 1, with the resilient stopper 16 engaging the successive ones of the notches 17 to provide a desired projection length of the blade 8 from the front opening 18 of the holder 1.

Since the finger retaining portion 4 of the blade carrier 3 has a width larger than that of the opening 5 of the channel 2 as stated before, the finger retaining portion 4 of the blade carrier 3 cannot be depressed. In other words, the finger retaining portion is locked against depression. However, when the blade carrier 3 is moved ahead to take the position shown in FIG. 2 where the front projection 13 is aligned with the opening 15, the finger retaining portion 4 is depressable because the opening 15 formed in the upper wall of the holder 1 receives the front downward projection 13 of the finger retaining portion 4 as illustrated in FIG. 2.

Figure 2:
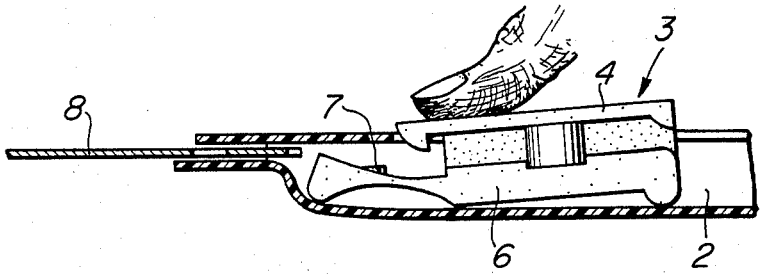
FIG. 2 is a longitudinal sectional view of the embodiment shown in FIG. 1 illustrating how a blade is disengaged from a blade carrier.

For renewing the blade, the blade carrier 3 as a whole is slid to the position shown in FIG. 2. Then, the front end portion of the finger retaining portion 4 is depressed downwardly. As a result, the slider 6 is deflected at its front portion around the slot 11 as if the front end portion is bent upwardly, because the front and rear legs 10 of the slider 6 are rigidly supported by the bottom of the channel 2 and because the portions of the slider 6 extending in parallel with the side portions 11*b* of the slot 11, have a reduced thickness to permit the resilient deflection. Consequently, the portion 21 of the upper wall of the slider 6 which is not deflected is lowered relatively to the front end portion of the slider around the slot to bring the circular projection 7 out of the aperture 9 in the base or rear end portion of the blade 8. In this state, the blade 8 can be extracted forwardly through the front opening 18 of the holder 1. Then, a new blade is inserted into the holder 1 through the front opening 18 until the base end of the blade 8 is stopped by a stopper 22 which is positioned such that the aperture 9 in the blade aligns with the projection 7 when the blade 8 is stopped by the stopper 21. Subsequently, as the finger retaining portion 4 is relieved from the manual depressing force, the slider 6 resumes the original form due to its resiliency, so that the circular projection 7 is automatically received by the aperture 9 to latch the blade 8. Then, the blade carrier 3 as a whole is moved back by manual force to provide a desired projecting length of the blade 8.

The projection 13 and the opening 15 for receiving the latter can be eliminated if the finger retaining portion 4 has a width smaller than that of the upper opening 5 of the channel. In this case, however, the slider 6 can be deflected irrespective of the position thereof to dangerously cause an unintentional dropping of the blade during the use. From this point of view, it is preferred to arrange the parts such that the deflection of the slider 6 is caused only when the blade carrier 3 takes a predetermined position as in the described embodiment.

Figure 6:
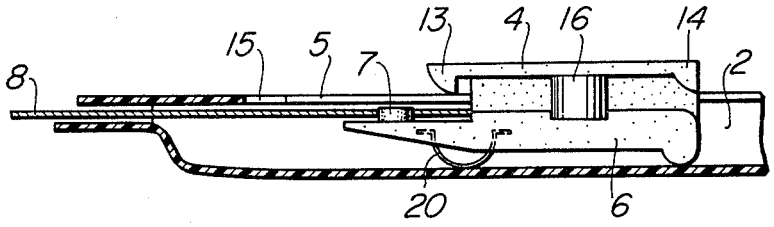
FIG. 6 is a longitudinal sectional view of a knife constructed in accordance with another embodiment of the invention.
Figure 7:
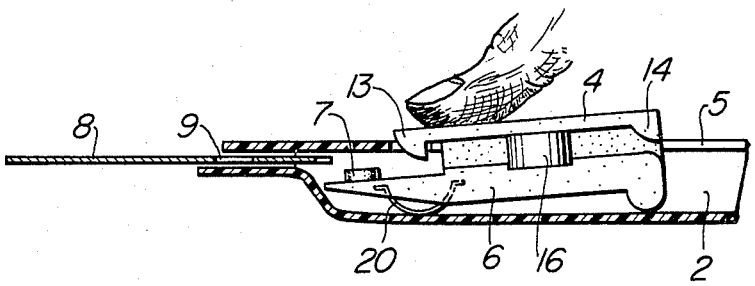
FIG. 7 is a longitudinal sectional view of the embodiment shown in FIG. 6, showing how the blade is disengaged from the blade carrier.

FIGS. 6 and 7 show another embodiment of the invention, in which the same reference numerals are used to denote parts or members which are the same as those of the first embodiment shown in FIGS. 1 to 5. This embodiment differs from the first embodiment in that the front leg of the slider 6 is omitted and that the front end portion of the slider 6 is resiliently supported on the bottom of the channel by means of a leaf spring 20 attached to the lower side of the slider 6. Also, the U-shaped slot is not formed.

It will be clear that this second embodiment provides substantially equivalent advantage to that presented by the first embodiment. Namely, as the front portion of the finger retaining portion 4 of the blade carrier 3 is depressed after the blade carrier has been moved to the position where the downward projection 13 is aligned with the opening 15, the slider 6 is inclined to lower the front end portion thereof as shown in FIG. 7, resiliently deforming the leaf spring 20. As a result, the cylindrical projection 7 is disengaged from the circular opening 9 of the blade 8 to permit the disengagement of the latter from the blade carrier 3. The attaching of the new blade is made in the reverse procedure as in the case of the first embodiment.

Although the invention has been described through its preferred forms, it is to be noted that the described embodiments are not exclusive and various changes and modifications may be imparted thereto without departing from the scope of the invention which is limited solely by the appended claims.

What is claimed is:

1. A knife having an elongated holder having a front end, a rear end, a top wall, a bottom wall, and two side walls and being provided with an interior, longitudinally extending channel the frontwardmost end region of which is located rearwardly of said front end of said holder, said channel being open to the exterior through a longitudinal slot provided in said top wall of said holder and having its frontwardmost end located a predetermined distance rearwardly of said frontwardmost end region of said channel, said holder further being provided at said front end thereof with an opening which communicates with said frontwardmost end region of said channel, a blade carrier including a slider slidably received by said channel and having a front end portion and a body portion disposed within said channel and a finger portion which is unitary with said body portion through said slot and is located exteriorly of said holder in overlying relation to said top wall, and a blade extending into said channel through said opening and having a base portion detachably secured to said blade holder through an engagement of a projection formed on said front end portion of said slider and an aperture formed in said base portion of said blade; characterized in that:

said slider has a rear end portion in sliding contact with the interior surface of said bottom wall of said holder, and said body portion, said rear end portion and said front end portion of said slider constitute a unitary, substantially rigid structure that is entirely confined within said holder, resilient means located entirely within the confines of said holder is operatively interposed between said slider and at least one of the interior wall surfaces of said holder for resiliently biasing said front end portion of said slider having said projection located thereat away from said interior surface of said bottom wall of said holder and so as to bring said projection into engagement with said aperture in said base portion of said blade, said finger portion in its forwardmost end region has a transverse extension overlying and in sliding contact with at least a portion of said top wall of said holder alongside said slot for normally inhibiting depression of said finger portion and therewith of said front end portion of said slider to prevent disengagement of said projection from said aperture, and said slot adjacent said frontwardmost end thereof is provided with a transverse enlargement shaped and dimentioned to permit entry of said transverse extension of said finger portion thereinto when the latter is moved to dispose said transverse extension in overlying relation to said enlargement of said slot for enabling depression of said finger portion and therewith of said front end portion of said slider to disengage said projection from said aperture against the resilient biasing force of said resilient means.

2. A knife as claimed in claim 1, wherein said resilient means includes a leg portion extending downwardly from the lower side of said body portion of said slider and adapted to make a sliding contact with the interior surface of said bottom wall of said holder, and said leg portion is connected to said body portion of said slider by a portion of reduced thickness to permit a resilient deflection of said body portion and therewith of said front end portion of said slider relative to said leg portion.

3. A knife as claimed in claim 2, wherein said leg portion is located frontwardly of said front end portion of said slider, said portion of reduced thickness comprises a pair of arms each unitary at one end with said body portion and at its other end with a respective side of said leg portion, and said arms and said leg portion being isolated from said front end portion of said slider by a substantially U-shaped slot formed through the thickness of said slider, whereby, when said finger portion is depressed upon said transverse extension thereof coming into alignment with said enlargement of said slot, said slider is deflected resiliently to displace said front end portion thereof away from said base portion of said blade and to disengage said projection from said aperture.

4. A knife as claimed in claim 1, wherein said resilient means includes a spring attached to the lower side of said front end portion of said slider and bearing against the interior surface of said bottom wall of said holder.

5. A knife as claimed in claim 1, wherein said transverse extension of said finger portion is wider than said slot and bridges the latter and is in sliding contact with said top wall of said holder on both sides of said slot, and said enlargement of said slot extends correspondingly to both sides of said slot.

6. A knife as claimed in claim 1, wherein said resilient means include spring means operatively interposed between a portion of said holder and a portion of said slider.

* * * * *